US005810345A

United States Patent [19]

Lehmann et al.

[11] Patent Number: 5,810,345

[45] Date of Patent: Sep. 22, 1998

[54] APPARATUS FOR PROCESSING PRINTED SHEETS WITH A FOLD

[75] Inventors: Peter Lehmann, Oftringen; Ernst Lüthi, Brittnau, both of Switzerland

[73] Assignee: Grapha-Holding AG, Hergiswil, Switzerland

[21] Appl. No.: 741,036

[22] Filed: Oct. 30, 1996

[30] Foreign Application Priority Data

Nov. 1, 1995 [CH] Switzerland ..... 03088/95

[51] Int. Cl.[6] ..... B65H 39/06

[52] U.S. Cl. ..... 270/52.26; 270/52.3

[58] Field of Search ..... 270/52.26, 52.27, 270/52.3

[56] References Cited

U.S. PATENT DOCUMENTS

| | | | |
|---|---|---|---|
| 2,969,981 | 1/1961 | Faeber . | |
| 4,732,374 | 3/1988 | Honegger | 270/55 |
| 5,052,667 | 10/1991 | Hansch | 270/55 |
| 5,104,108 | 4/1992 | Honegger | 270/55 |
| 5,292,110 | 3/1994 | Honegger | 270/58 |
| 5,324,014 | 6/1994 | Honegger et al. | 271/271 |
| 5,464,199 | 11/1995 | Stauber | 270/53 |
| 5,551,682 | 9/1996 | Luthi | 270/52.18 |
| 5,655,760 | 8/1997 | Herman | 270/52.26 |
| 5,657,978 | 8/1997 | Meier et al. | 270/52.3 |
| 5,713,565 | 2/1998 | Meier | 270/52.3 |

FOREIGN PATENT DOCUMENTS

| | | |
|---|---|---|
| 0095603 | 12/1983 | European Pat. Off. . |
| 0218804 | 4/1987 | European Pat. Off. . |
| 3620945A1 | 1/1987 | Germany . |

*Primary Examiner*—David A. Okonsky
*Attorney, Agent, or Firm*—Spencer & Frank

[57] ABSTRACT

An apparatus for processing folded printed sheets includes a work station for processing the folded printed sheets and a conveying device driven with a transporting movement in a direction along a conveying path that is arranged alongside the work station. Saddle-shaped supports are attached to the conveying device and have supporting edges on which the printed sheets can be supported respectively along their fold by straddling the supporting edge of the respective saddle-shaped support. The saddle-shaped supports are conveyed along the conveying path so that the supporting edges are positioned transverse to the conveying path at a distance to each other and move successively past the work station which cooperates with the saddle-shaped supports respectively while the saddle-shaped supports are transported past the work station. A mechanism movably attaches the saddle-shaped supports on the conveying device and guides the respective supporting edges along a movement path in which, in a region of cooperation with the work station, a relative speed component of the supporting edges parallel to the conveying path, with respect to the work station, is smaller than a relative speed for the transporting movement of the conveying device.

10 Claims, 3 Drawing Sheets

APPARATUS FOR PROCESSING PRINTED SHEETS WITH A FOLD

CROSS-REFERENCE TO RELATED APPLICATIONS

The present application claims the right of priority of Application No. 03088/95 filed in Switzerland on Nov. 1, 1995, the disclosure of which is incorporated herein by reference.

BACKGROUND OF THE INVENTION

The invention relates to an apparatus for processing folded printed sheets, with at least one work station that is arranged along a conveying path, a conveying device that is driven with a transporting movement in a direction along the conveying path, and to which saddle-shaped supports are attached on which the printed sheets can be supported respectively along their fold by straddling a supporting edge of the respective saddle-shaped support that extends in the direction of the fold. The saddle-shaped supports are transported on the conveying device with their supporting edges positioned transverse to the conveying path and at a distance to each other. The saddle-shaped supports with their supporting edges successively pass one or more work stations which cooperate with the supports as the supports pass by. Such apparatuses are used in particular to gather the folded printed sheets and, if necessary, for a subsequent wire stitching of the gathered printed sheets. In such an arrangement, several work stations arranged along the conveying path are designed as printed sheet feeders with which the individual printed sheets are deposited on the saddle-shaped supports. Thus, a printed sheet is deposited by a page feeder arranged upstream with respect to the transport movement, has another printed sheet deposited thereon by a following printed sheet feeder in the downstream direction. As a result, the printed sheets are gathered from the inside out with respect to the final printed product. A subsequent wire stitching of the printed sheets, gathered on the individual supports, takes place in a work station that is designed as a wire stitching machine which is arranged downstream of the printed sheet feeders.

In general, a problem with such an apparatus has to do with cooperation of the work stations with the saddle-shaped supports that takes place while the supports are transported past the work stations. Since the relative speed of the conveying device with respect to the work stations that are installed stationary along the conveying path should not be too low in order to achieve a high production capacity, special measures, which take into account the transport movement of the supports, are necessary to synchronize the operational sequence of the work stations in the region of cooperation between work stations and supports.

European Application EP-A-0 095 603 discloses an apparatus of the aforementioned type, designed for gathering printed sheets, in which work stations functioning as feeders for the printed sheets, are formed by long, stretched-out ends of gripper conveyors, which are aligned along the conveying path, the claws of which are transported at a distance one after the other on an endlessly circulating traction element and which hold the printed sheets that are to be supplied to the conveying path along their fold. Owing to the fact that the feeding movement of the gripper conveyors and the transport movement of the conveying device are in the same direction, there is requirement for movement synchronization in the direction of the conveying path between the supplied printed sheets and the saddle-shaped supports.

This design leads to a comparatively large overall length for the work stations that serve as printed sheet feeders, as seen in the conveying path direction. Thus, the conveying path becomes relatively long if several printed sheet feeders are arranged successively. Added to this is the fact that opening devices, which are effective between the gripper conveyors and the saddle-shaped supports and are absolutely necessary for opening the printed sheets prior to their transfer to the saddle-shaped supports, necessitate a design that is relatively complicated and possibly susceptible to trouble because they must perform the opening operation on the printed sheets moving along the gripper conveyors.

SUMMARY OF THE INVENTION

It is an object of the invention to create an apparatus of the aforementioned type which makes it possible to realize in a simple and reliable manner the synchronization qualities, necessary for the cooperation between a work station and the gathering sections while the supports of the conveying device are transported past the work station.

The above and other objects are accomplished in accordance with the invention by the provision of an apparatus for processing folded printed sheets, comprising: a work station for processing the folded printed sheets; a conveying device driven with a transporting movement in a direction along a conveying path that is arranged alongside the work station; saddle-shaped supports, attached to the conveying device, having supporting edges on which the printed sheets can be supported respectively along their fold by straddling the supporting edge of the respective saddle-shaped supports, the saddle-shaped supports being conveyed along the conveying path so that the supporting edges are positioned transverse to the conveying path, at a distance to each other, and move successively past the work station which cooperates with the saddle-shaped supports, respectively, while the saddle-shaped supports are transported past the work station; and attaching means for movably attaching the saddle-shaped supports on the conveying device and respectively guiding the supporting edges along a movement path on which, in a region of cooperation with the work station, a relative speed component of the supporting edges parallel to the conveying path and with respect to the work station is smaller than a relative speed for the transporting movement of the conveying device.

Thus, the solution according to the invention is that the supports are mounted movably on the conveying device and are in each case transported with their supporting edges along a movement path on which, in the region of cooperation with the work station, the component of the relative speed of the support edges with respect to the work station, which component runs parallel to the conveying path, is smaller than the relative speed of the transport movement of the conveying device, also with respect to the work station.

Thus, the standard rigid mounting of the saddle-shaped supports on the conveying device, which causes the saddle-shaped supports to pass by the work station or stations with the relative speed of the transport movement of the conveying device, is replaced according to the invention with the movable mounting of the supports on the conveying device. This movable mounting is designed such that at least the supporting edges of the saddle-shaped supports can be moved along the movement path, which causes the lowering of the relative speed component, directed parallel to the conveying path, as compared to the relative speed for the transporting movement of the conveying device, while the saddle-shaped supports move through the region of cooperation with the work station. Depending on how much the relative speed component that is parallel to the conveying path is lowered, the time for the supports in the region of cooperation with the respective feeding station is extended, if necessary to a temporary relative standstill between support and work station. As a result of the invention, it is not necessary in most cases to provide any measures at the work station designed to have the elements that act upon the supports track the same. Insofar as such measures are still useful or required in individual cases, they can be designed much simpler because of the lowering of the relative speed.

In one preferred embodiment of the invention, it is provided that the relative speed component for the support edges, which runs parallel to the conveying path, drops in the region of cooperation to approximately zero. As a result, the supporting edge of the respective saddle-shaped support is stopped or nearly stopped inside the region of cooperation with the work station. This fact can be used with respect to the synchronizing of particularly critical phases of the cooperation between the supports and the respective work station.

In accordance with an additional aspect of the invention, an embodiment of the movable mounting of the supports on the conveying device is provided, in that the movement path of the supporting edges includes a movement component transverse to the conveying path, which component points toward the work station at the place where the supporting edges enter the region of cooperation and which points away from the work station when the supporting edges leave the region of cooperation. The movement component for the supports or their supporting edges that is transverse to the conveying path can in many ways support the operation of the work station, which is directed toward the conveying path. If, for example, the work station is a feeding station for printed sheets, which spreads open the print ed sheets on the side opposite the fold and deposits them on the supports, the movement component directed toward the work station assists the sliding in of the supporting edge into the spread printed sheets, while the subsequent counter movement removes the support with the straddling printed sheets safely from the range of action of the feeding station.

Numerous different options of varied simplicity or complexity are conceivable for the design of the movable mounting for the supports on the conveying device and the drive that effects the guidance along the movement path. The most favorable form is advisably selected by taking into account the concrete shape of the work stations and the required processing speeds.

A particularly simple structural embodiment consists of connecting the supports to the conveying device in each case such that they swivel, with the aid of a swiveling axle defining a swivel axis that runs parallel to and at a distance to the supporting edge, around which the supports are swiveled respectively during their transport through the region of cooperation, such that they face progressively in the direction opposite the transporting direction of the conveying device. The progressive swiveling of the supports counter to the transporting direction causes a movement speed for the supporting edges that is opposite in direction to the relative speed of the transport movement for the conveying device relative to the work station. A suitable selection of the angular speed for swiveling makes it possible to reduce the relative speed component for the supporting edges, which runs parallel to the conveying path with respect to the work station, temporarily to a value near zero. Before the supports arrive along the conveying path in the region of cooperation with the work station, they are swiveled to a forward position with respect to the direction of conveyance along the conveying path. Following a swiveling of the supports in the opposite direction during the passing through of the region of cooperation, they leave the region of cooperation in a position that is counter to the direction of conveyance along the conveying path. If necessary, the supports can be swiveled once more to a starting position that is suitable for entering the region of cooperation for the next work station before reaching that work station.

In this connection, a suitable additional embodiment of the invention distinguishes itself in that the swivel axis on the conveying device can be moved transverse to its direction and to the conveying path. In this case, the crank axle of a crank drive arranged on the conveying device is connected to the support at a distance from and parallel to the swivel axis. The guiding of the support by the rotating crank axle, in connection with the movable mounting of the swiveling axis, results in a movement path for the supporting edge, which has a path component that runs parallel to the conveying path as well as one that runs transverse to it. The parallel path component is designed to reduce the relative speed with respect to the work station by a movement counter to the conveying direction, while the transverse path component causes a movement of the supporting edge in the direction of the work station that is transverse to the conveying path.

In place of the swiveling of the supports, explained in the above with the special embodiments, the supports can also be moved along movement paths where the angular position of the supports relative to the conveying path is maintained constant. In this connection, a suitable and structurally simple embodiment consists of connecting the supports in each case to two crank axles of two crank drives attached to the conveying device, which crank axles are fastened at a distance to each other, parallel to the supporting edge and rotating in phase as well as counter to the conveying direction of the conveying device. In this case, the supports swing back and forth in the direction of the conveying path as well as in the transverse direction, while the angular position of the supports relative to the conveying path remains the same. During the phase of the swinging movement that is counter to the transporting movement of the conveying device, the relative speed component for the supporting edge, which runs parallel to the conveying path, is reduced.

It is advisable in most cases if the saddle-shaped supports extend at a right angle to the conveying path, meaning that the center plane that is symmetrical to the printed sheets hanging down on both sides of the supporting edge, runs orthogonal to the conveying path. It is then advisable if the connecting line for both crank axles runs orthogonal to the conveying path.

Numerous options are also conceivable for operating the various means for the movable mounting of the supports and their guidance along their movement path, as has been explained in detail in the above with the aid of swiveling and crank mechanisms. For example, it is advisable if the drive energy for the swiveling and crank mechanism is derived from the transporting movement of the conveying device. For one suitable embodiment in this connection, a control path that is stationary relative to the conveying device is arranged on the conveying path in the region of the work station along which radial cams, that are connected to the supports and are carried along by the conveying device as a result of its transporting movement, function to drive the supports along their movement path. In that the radial cams that move along with the conveying device are moved along the stationary control path by the conveying device, the radial cams experience a movement that corresponds to the curve shape of the control path and thus is available for driving the supports along their movement path.

The use of the invention is particularly important in apparatuses where at least one work station is formed by a printed sheet feeder, which opens the printed sheets on the side opposite their fold and places them on a respective one of the supports in a feeding direction that is transverse to the conveying path, and/or where at least one work station is formed by a wire stitching machine that stitches the printed sheets that are straddling the supports along their fold.

In both cases, the lowering of the relative speed component for the supporting edges, which runs parallel to the conveying path, leads to a sufficiently long time interval of a near standstill between work station and gathering section with respect to the transporting movement along the conveying path. This near standstill can be used for performing critical phases during the transfer of the printed sheets to the supports or during the placement of the wire staples. This results in a high processing speed, while making it unnecessary for the work stations themselves to follow the transport movement of the conveying device, which involves high expenditure.

Other features, details and advantages of the invention result from the following description where the invention is explained in more detail with the aid of the drawing.

BRIEF DESCRIPTION OF THE DRAWINGS

FIG. 2(*b*) is an elevational view of a support from the direction of arrow III in FIG. 2(*a*).

DETAILED DESCRIPTION OF THE PREFERRED EMBODIMENTS

Figure 1:
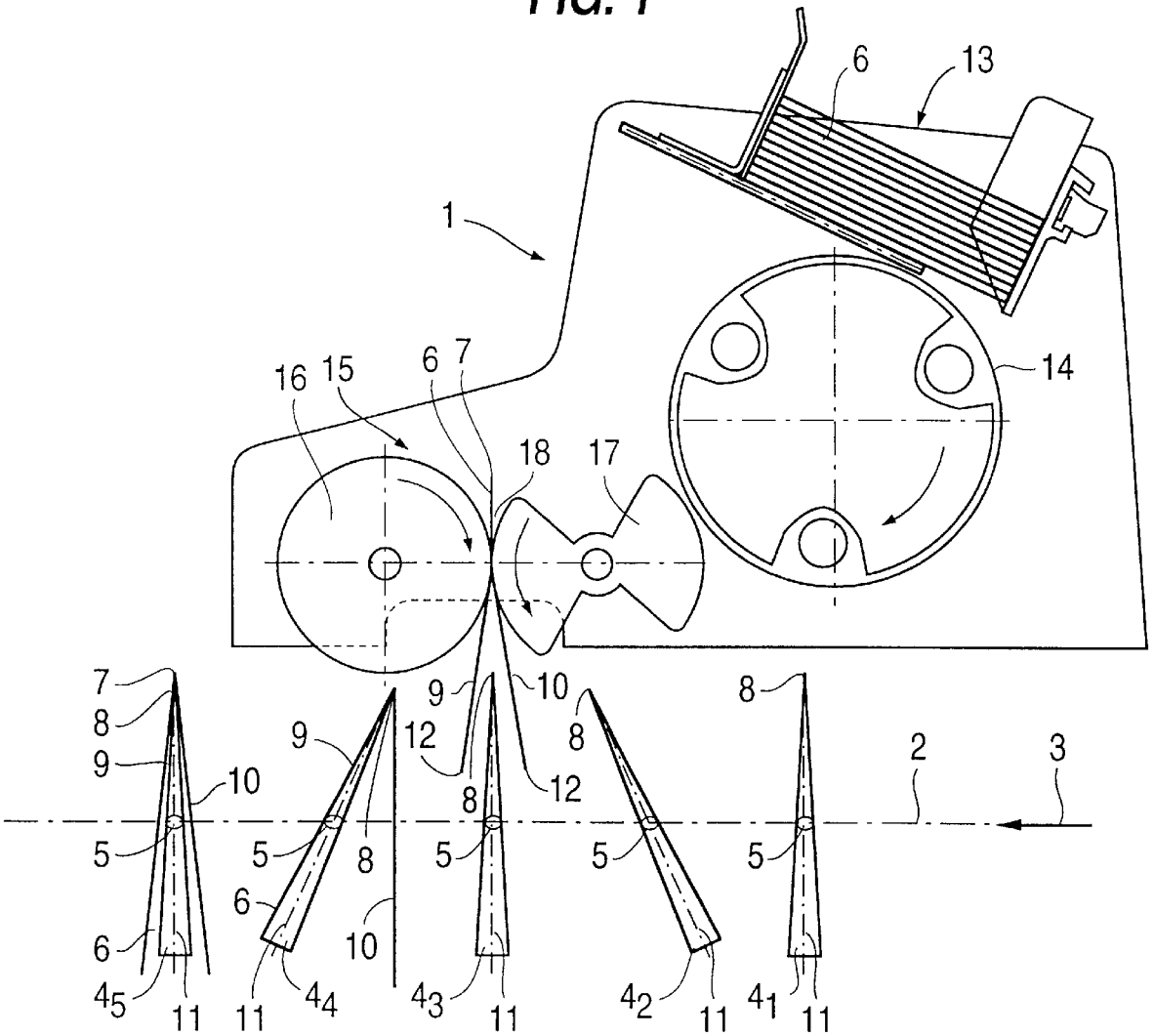
FIG. 1 is a side view of a region a conveying device adjacent a work station in accordance with the invention.

Referring to FIG. 1, there is shown a region of cooperation between a work station and a conveying device in accordance with the invention. In FIG. 1, the work station is shown schematically as a sheet feeder 1 disposed adjacent a conveying path 2, which moves in a straight line in the region of the sheet feeder 1 and is diagrammatically represented by a line with long and short dashes. A conveying device (shown in FIG. 2) extends along conveying path 2 in the form of an endlessly circulating traction element 20, which is driven along conveying path 2 in a direction of a transport movement that is indicated by arrow 3.

Saddle-shaped supports 4 are coupled to the conveying device at equal distances to each other by means of swiveling axles 5' defining swivel axes 5, shown in a diagrammatic view. As can be seen from the far left in FIG. 1, printed sheets 6 are shown resting in a straddling manner on saddle-shaped support $\mathbf{4}_5$. The printed sheets are folded approximately in their center so as to present a fold 7 and printed pages 9 and 10 on either side of the fold. Printed sheets 6 are supported along their fold 7 on a supporting edge 8 of the respective support. Supporting edges 8 extend transverse to the conveying path 2 and perpendicular to the drawing plane of FIG. 1. In the position where they straddle support 4, printed pages 9 and 10 of printed sheet 6 extend on both sides of center plane 11 of the respective support 4 that runs through supporting edge 8 and the respective swivel axis 5.

Printed sheet feeder 1, which serves as a work station, cooperates with saddle-shaped supports 4 while the supports are transported past in the direction of arrow 3. The printed sheet feeder opens the printed sheets 6 at the free edges 12 opposite fold 7 and respectively transfers them to supports 4. More specifically, printed sheets 6, which are stored for this purpose in a stacking magazine 13, as indicated schematically in the illustration of the sheet feeder 1 in FIG. 1, are fed individually and successively to an opening apparatus 15 by a delivery roller 14, which respectively removes a bottom printed sheet 6 with the aid of non-depicted grippers from stacking magazine 13. With this opening device, individual printed sheets 6 are gripped by controlled grippers (not shown) that are attached to counter-rotating opening elements 16, 17 at free edges 12, one of which can protrude somewhat over the other one by forming a pre-fold, and are spread open so that free edges 12 are arranged, respectively, on both sides of a saddle-shaped support $\mathbf{4}_3$ which has moved in a straight line along conveying path 2 toward a roll slit 18, formed between opening elements 16, 17. During this movement phase, the controlled grippers for opening elements 16, 17 release free edges 12 of the opened printed sheet, causing it to be deposited, while passing through roll slit 18, on the respective saddle-shaped support 4 in a feed direction that is transverse to conveying path 2. For designs without a roll slit 18, the movement for depositing the opened printed sheets 6 would take place only under the effects of gravity, which permits printed sheets 6 to drop from sheet feeder 1 that is arranged above conveying path 2, as seen in the direction of gravity.

From FIG. 1 it can also be seen that supporting edges 8 for supports 4, which are pointed toward sheet feeder 1, while they are being transported past the sheet feeder 1 in the direction of arrow 3, are guided along a certain movement path, starting from an angular position of support $\mathbf{4}_1$ as shown in FIG. 1 on the extreme right which has its center plane 11 extending orthogonally to the conveying path 2. This movement path results from the fact that support $\mathbf{4}_1$, which is initially aligned with its center plane orthogonal to the conveying path 2, is swiveled to a position shown for support $\mathbf{4}_2$ during the transport of the conveying device in the direction of arrow 3 and prior to its entering the region of cooperation with sheet feeder 1. In this angular position, center plane 11 of support $\mathbf{4}_2$ extends with a sharp angle that opens in the direction of arrow 3, with regard to the conveying path 2. During the following entrance of the support 4 into the region of cooperation, the support is swiveled back increasingly counter to the direction of the transporting movement 3 of the conveying device, wherein the orthogonal angular position of center plane 11, shown for support $\mathbf{4}_3$, is again reached in the center of the region of cooperation. The swiveling counter to the direction of transport movement continues progressively until the support 4 once more leaves the region of cooperation in the angular position shown for support $\mathbf{4}_4$, which is an almost symmetrical mirror image of the angular position shown for the support $\mathbf{4}_2$. During the further course of the transport movement of the conveying device, support 4 is returned outside of the region of cooperation once more to the orthogonal position shown for support $\mathbf{4}_5$.

While supporting edge 8 moves along the previously explained movement path, supporting edge 8 thus moves in the region of cooperation with sheet feeder 1 counter to the direction of transport movement 3 of the conveying device, as a result of which the relative speed component for supporting edge 8 parallel to conveying path 2, with respect to stationary sheet feeder 1 and in particular its stationary opening apparatus 15, is smaller than the relative speed of the transporting movement 3 of the conveying device and can be reduced temporarily to zero with a suitable selection of the angular speed for the swiveling movement of supports 4. This means that during the actual transfer operation, the respective support $\mathbf{4}_3$ is at a standstill relative to the printed sheet 6, as seen in the direction of transport movement 3.

Figure 2B:
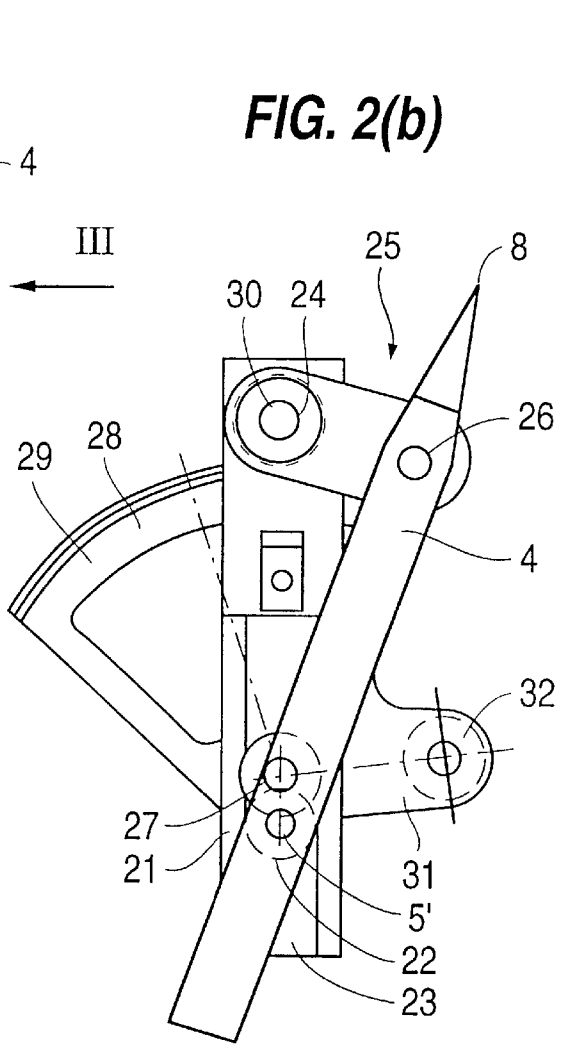
FIG. 2(*a*) is a cross-sectional view of a support and the associated mechanism attaching the support to a conveying device according to the invention.
Figure 2A:
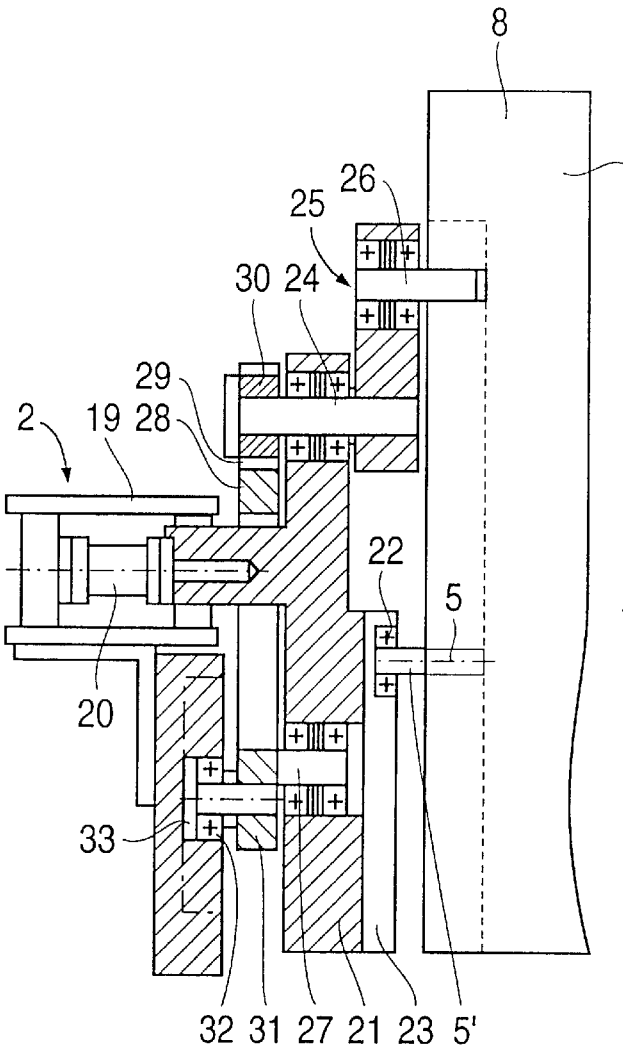

Details concerning the mounting of saddle-shaped supports 4 on the conveying device are shown in FIGS. 2(*a*) and 2(*b*) for the case that a movement component transverse to the conveying path 2 is also superimposed on the swiveling movement for supports 4. The first thing to notice in the sectional view in FIG. 2(*a*), which is orthogonal to conveying path 2, is the conveying device which consists of an endless traction element 20, guided in a rail 19, and to which a bearing plate 21 is attached rigidly, which can also be seen in the view from above in FIG. 2(*b*). Swiveling axle 5 and its swivel axis 5' for saddle-shaped support 4, is arranged at a distance from and parallel to supporting edge 8 and can be moved longitudinally by a bearing roller 22 inside a guide groove 23 that is formed in bearing plate 21. Groove 23 extends over the drawing plane of FIG. 2(*a*) and is orthogonal to conveying path 2.

Also positioned rotatable in bearing plate 21 is a rotatable, centered shaft 24 for a crank drive 25. An eccentric crank axle 26, which is parallel to swivel axis 5', is connected to support 4 at a distance from swivel axis 5', that is closer to supporting edge 8 as compared to the swivel axis.

A toothed segment 28 is positioned rotatable on bearing plate 21, on the side facing away from support 4, by a shaft defining a rotational axis 27 that is parallel to swivel axis 5'. A toothed region 29 of toothed segment 28 drivingly engages with a pinion gear 30 that is arranged on centered shaft 24 of crank drive 25. A lever-type extension 31 of toothed segment 28, that extends outward from the region of rotational axis 27, has a guide roller 32 that functions as a radial cam on its free end, that is on the side pointing toward traction element 20. In the region for work station 1, guide roller 32 is guided inside a control path 33 that is rigidly fixed to conveying path 2 and starts a controlled movement for toothed segment 28 during its passage along control path 33, which is initiated by traction element 20 via connected bearing plate 21. As a result of this, crank drive 25 is activated in one rotational direction, which, during the transport of support 4 through the region of cooperation with the work station 1, causes a movement component for supporting edge 8 that is counter to the direction of the transport movement 3 of traction element 20, through which the relative speed component that is parallel to conveying path 2, with respect to the work station 1, is lowered to approximately zero. Supporting edge 8 moves at the same time according to a movement component that runs transverse to conveying path 2 and which, in the course of entering the region of cooperation for the work station, is pointed toward the work station while, during the course of leaving the region of cooperation it is pointed away from work station 1. This additional movement component further strengthens the operation of transferring printed sheets 6 to supports 4, for example in the case of sheet feeder 1.

Figure 3:
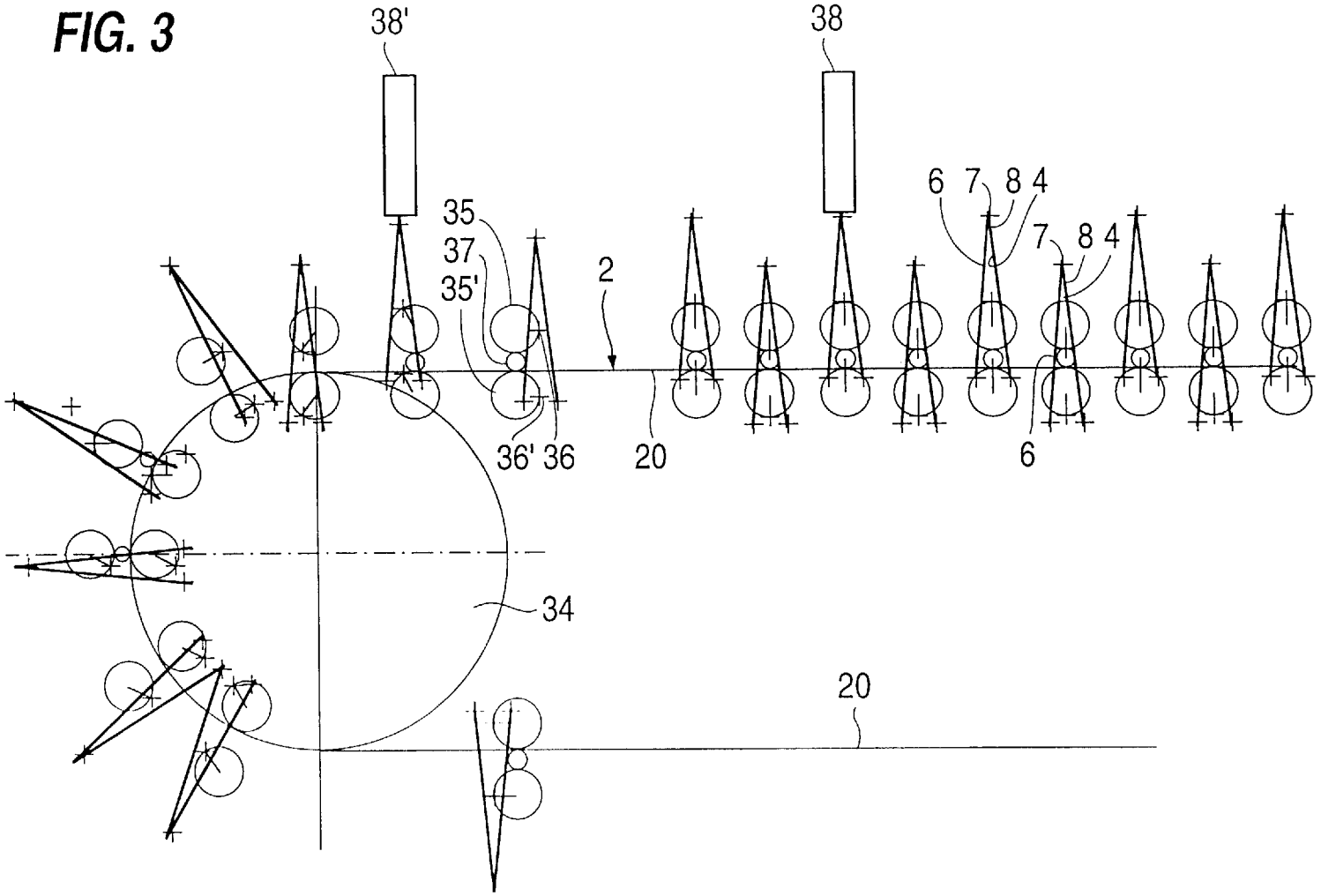
FIG. 3 is a schematic showing a partial side view of a conveying device with saddle-shaped supports designed for wire stitching of gathered printed sheets.

For the embodiment shown in FIG. 3, endlessly circulating traction element 20, which constitutes the conveying device, is shown diagrammatically as a thin line, which also indicates that traction element 20, together with transported saddle-shaped supports 4, is returned to a non-depicted driving wheel by way of a deflection wheel 34. For each support 4, two crank drives 35, 35' are attached rigidly to the traction element 20, for which respective crank axles 36, 36' are driven in phase by means of a schematically indicated intermediate wheel 37. Crank axles 36, 36', which are arranged at a distance to each other and parallel to supporting edge 8 of a respective one of the supports 4, are connected to the respective supports 4. As a result of being driven in phase, the direction of the imagined connecting line for the two crank axles 36, 36' remains constant in space and runs transverse to conveying path 2 for the embodiment shown in FIG. 3. The connecting points for crank axles 36, 36' are located at a distance to each other on the center plane 11 for supports 4. For that reason, the supports 4 are always aligned orthogonally to conveying path 2.

Similar to the case in FIGS. 2(*a*) and 2(*b*), the drive energy for crank drives 35, 35' is derived from the transporting movement of traction element 20, which is transferred by control cams that engage in a locally fixed control path. The control path can be designed such that respectively following supports 4 are displaced in their movement phase against each other by 180°. As a result of this, two work stations 38 or 38', which are arranged on conveying path 2 and function as wire stitching machines, in each case perform a stitching movement only on every second support 4 that is transported past, provided the location of the wire stitching machines 38 or 38', as shown in FIG. 3, is selected suitably in accordance with the movement phase of crank drives 35, 35'.

Deflection wheel 34 in FIG. 3 rotates counter-clockwise so that supports 4 are transported past wire stitching machines 38, 38' in a direction from right to left. Crank drives 35, 35', on the other hand, rotate clockwise, which causes the movement component of the relative speed for supports 4 that runs parallel to conveying path 2, with respect to wire stitching machines 38 or 38', to be held temporarily near zero in the region of cooperation for the supports 4.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. An apparatus for processing folded printed sheets, comprising:

a work station for processing the folded printed sheets;

a conveying device driven with a transporting movement in a direction along a conveying path that is arranged alongside the work station;

saddle-shaped supports, attached to the conveying device, having supporting edges on which the printed sheets can be supported respectively along their fold by straddling the supporting edge of the respective saddle-shaped supports, the saddle-shaped supports being conveyed along the conveying path so that the supporting edges are positioned transverse to the conveying path, at a distance to each other, and move successively past the work station which cooperates with the saddle-shaped supports, respectively, while the saddle-shaped supports are transported past the work station; and attaching means for movably attaching the saddle-shaped supports on the conveying device and respectively guiding the supporting edges along a movement path on which, in a region of cooperation with the work station, a relative speed component of the supporting edges parallel to the conveying path, with respect to the work station, is smaller than a relative speed for the transporting movement of the conveying device.

2. The apparatus according to claim 1, wherein the attaching means reduces the relative speed component for the supporting edges to nearly zero in the region of cooperation.

3. The apparatus according to claim 1, wherein the attaching means guides the supporting edges so that in the region of cooperation the supporting edges have a movement component transverse to the conveying path which points toward the work station as the supporting edges enter the region of cooperation and points away from the work station as the supporting edges leave the region of cooperation.

4. The apparatus according to claim 1, wherein the saddle-shaped supports each include a swiveling axle having a swivel axis that is at a distance from and parallel to the supporting edge, and the saddle-shaped supports are attached to the conveying device by the swiveling axle so that the saddle-shaped supports can swivel about the swivel axis, wherein the attaching means swivels the saddle-shaped supports, respectively, around the swivel axis progressively counter to the transporting direction of the conveying device while being transported through the region of cooperation.

5. The apparatus according to claim 4, wherein the swiveling axle is mounted to the conveying device for movement transverse to the swivel axis and to the conveying path, and the apparatus further includes crank drives arranged on the conveying device, each crank drive having a crank axle connected to a respective one of the saddle-shaped supports parallel to and at a distance from the swivel axis for rotating the saddle-shaped support about the swivel axis.

6. The apparatus according to claim 4, wherein the crank drives includes a pair of crank drives drivingly connected to each saddle-shaped support by a respective crank axle, the crank axles of the pair of crank drives being positioned at a distance to each other and parallel to the supporting edge of the saddle-shaped support and circulating in phase and counter to the direction of transporting movement of the conveying device.

7. The apparatus according to claim 6, wherein the crank axles of each pair of crank drives have a connecting line extending orthogonally to the conveying path.

8. The apparatus according to claim 1, and further including a guide defining a control path arranged along the conveying path in the region of cooperation with the work station and which is stationary with respect to the conveying device, and control cams connected to the saddle-shaped supports and carried along by the transport movement of the conveying device through the control path for controlling the movement path of the support edges.

9. The apparatus according to claim 1, wherein the work station comprises a printed sheet feeder which opens the individual printed sheets on their side opposite their fold and which deposits the opened printed sheets in a feeder direction transverse to the conveying path on a respective one of the saddle-shaped supports.

10. The apparatus according to claim 1, wherein the work station comprises a wire stitching machine which wire stitches the printed sheets riding on the saddle-shaped supports along their fold.

* * * * *